United States Patent [19]

Cherrington

[11] 4,043,136

[45] Aug. 23, 1977

[54] SYSTEM AND METHOD FOR INSTALLING PRODUCTION CASINGS

[75] Inventor: Martin D. Cherrington, Sacramento, Calif.

[73] Assignee: Tidril Corporation, Sacramento, Calif.

[21] Appl. No.: 595,830

[22] Filed: July 14, 1975

[51] Int. Cl.[2] ..... F16L 1/02; E02D 29/10

[52] U.S. Cl. ..... 61/72.7; 175/53; 175/62; 175/72; 175/215

[58] Field of Search ..... 61/42, 72.1–72.7, 61/84, 85; 175/53, 62, 72, 215

[56] References Cited

U.S. PATENT DOCUMENTS

| | | | |
|---|---|---|---|
| 1,993,366 | 3/1935 | Englebright | 61/84 X |
| 2,951,680 | 9/1960 | Camp et al. | 175/72 X |
| 3,589,135 | 6/1971 | Ede | 61/72.1 |
| 3,635,036 | 1/1972 | Hooper | 61/72.1 |
| 3,894,402 | 7/1975 | Cherrington | 61/72.4 |
| 3,902,563 | 9/1975 | Dunn | 175/62 |

FOREIGN PATENT DOCUMENTS

| | | | |
|---|---|---|---|
| 2,122,212 | 11/1972 | Germany | 61/72.1 |

*Primary Examiner*—Paul R. Gilliam

*Assistant Examiner*—David H. Corbin

*Attorney, Agent, or Firm*—Townsend and Townsend

[57] ABSTRACT

A system and method for emplacing a relatively large casing under and spanning an obstacle such as a river is disclosed. The casing is emplaced along the path of a previously bored and placed existing pilot string running beneath the obstacle. The pilot string extends typically in an inverted arcuate contour from a first position at or near ground level on one side of the obstacle to a second position at or near ground level on the other side of the obstacle. The system includes apparatus for concentrically reaming the pilot hole to an enlarged diameter and entraining the cuttings from the excavated annulus of the reaming operation in drilling mud. The casing is advanced along the reamed pilot hole in following relationship to the reaming apparatus. A seal is provided between the outer surface of the leading portion of the casing and the reamed pilot hole so that the drilling mud containing the entrained cuttings flows into the leading end of the advancing casing. The drilling mud flowing into the leading end of the casing is impelled, typically by an auger, toward the trailing end of the casing to remove the drilling mud from the reamed pilot hole and prevent the cuttings from settling in an annulus circumscribing the casing.

14 Claims, 4 Drawing Figures

SYSTEM AND METHOD FOR INSTALLING PRODUCTION CASINGS

FIELD OF THE INVENTION

The present invention relates to a system and method for emplacing a casing under a surface obstacle such as a river, and in particular to such a system and method wherein all cuttings are removed from the hole to prevent freezing of the production casing as it is being installed.

DESCRIPTION OF THE PRIOR AND CONTEMPORANEOUS ART

Techniques have recently been developed for installing relatively large diameter casings beneath rivers and other surface obstacles without dredging the riverbed or otherwise altering the obstacle itself. Instead, a pilot hole is first drilled from a position at or near the surface on one side of the obstacle to a position at or near ground level on the other side. See my U.S. Pat. No. 3,878,903 entitled APPARATUS AND METHOD FOR DRILLING UNDERGROUND ARCUATE PATHS issued Apr. 22, 1975. After drilling the pilot hole, the pilot drill string used to drill the pilot hole remains in the hole. A reamer is then attached to one end of the drill string and is drawn or forced through the pilot hole about the pilot string to ream the pilot hole to a preselected larger diameter. The production casing or other large diameter casing moves into the reamed annulus about the pilot string in the pilot hole in following relationship to the reaming apparatus. As a result, when the pilot hole has been reamed from one end to the other, the larger casing occupies the reamed hole.

In the recently developed techniques discussed above for installing casings along the path of a pilot hole, the cuttings from the reamer are entrained in a transport fluid such as drilling mud. The reamed pilot hole has a slightly greater diameter than the outer diameter of the casing, and the drilling mud containing the entrained cuttings flows out of the hole through the annular space circumscribing the casing. It has been found that as long as the drilling mud containing the entrained cuttings flows along the casing, the casing will move smoothly into the hole because the flowing drilling mud greatly reduces friction between the casing and the sides of the reamed pilot hole.

The above method of placing large diameter casings beneath surface obstacles has proved to be quite effective when relatively short distances are to be traversed. However, where large crossings must be made, such as under a river which can be up to one mile wide, the above techniques have proved to be ineffective. As the large casing is being advanced into the ground, the pressure at which the drilling mud must be forced into the hole so that it will flow along the outside of the large casing increases. In relatively soft ground such as a riverbed, the drilling mud at such higher pressures acts to hollow out the reamed pilot hole, greatly increasing the volumetric rate of flow of the drilling mud required to maintain a continuous flow of such mud into and out of the reamed hole. As the distance along which the large casing has been advanced increases, the volumetric rate of flow and the pressure required to maintain continuous flow increase in a nonlinear fashion because of the hollowing out of the hole. Eventually, either the capacity of the pumps injecting the drilling mud into the hole is exceeded or the hole blows out through soil strata near its leading end, and the continuous flow of the drilling mud out of the hole along the outside of the large casing ceases.

When the flow of drilling mud along the outer surface of the large casing stops, the cuttings will remain in the hole and accumulate. The stationary cuttings will thus surround the casing as it is being advanced into the hole, and the lubricity of the fluid is lost. The friction on the casing will increase dramatically and typically freeze the casing in the hole. Once movement of the casing stops, static friction must be overcome to further advance the casing, which is larger than dynamic friction and the casing ordinarily cannot be moved and remains frozen in the hole.

SUMMARY OF THE INVENTION

The present invention provides a system and method for emplacing a relatively large casing under and spanning an obstacle such as a river. The casing is emplaced along the path of an existing pilot string running beneath the obstacle. The pilot string extends in an inverted arcuate path from a first position at or near ground level on one side of the obstacle to a second position at or near ground level on the other side of the obstacle. The system includes apparatus for reaming an annulus concentrically about the pilot string to a preselected diameter and entraining the cuttings from the reaming operation in drilling mud. The casing is advanced along the reamed pilot hole in following relationship to the reaming apparatus. A seal is provided between the outer surface of the leading portion of the casing and the reamed pilot hole so that the drilling mud containing the entrained cuttings flows into the leading end of the advancing casing. The drilling mud flowing into the leading end of the casing is impelled, typically by an auger, toward the trailing end of the casing to remove the drilling mud from the reamed pilot hole and prevent the cuttings from settling in an annulus circumscribing the casing.

In the system of the present invention, the drilling mud with the entrained cuttings does not flow along the outer surface of the casing as with existing systems. Instead, the drilling mud is confined within the casing itself so that it cannot hollow out the hole. Hollowing out of the hole had resulted in nonlinear increases in the pressure and volumetric flow required to maintain continuous flow of the drilling mud in the past, but is avoided with the present invention. Substantially all of the cuttings are removed from the hole as the drilling mud passes out of the hole through the interior of the casing. Because the drilling mud flows through the interior of the casing rather than around the outside of the casing, the flow will be continuous. The cuttings cannot become trapped in the space surrounding the casing to freeze the casing in place and prevent further movement thereof, a common occurrence in prior systems.

The drilling mud containing the entrained cuttings is forced along the interior of the casing by impelling apparatus located within the casing near the leading end thereof. In the preferred embodiment of the present invention, the impelling means comprises an auger extending at least part way from the leading end of the casing to the trailing end. In addition, suction can be provided at the trailing end of the casing. Both the impelling apparatus and the suction apparatus facilitate the continuous cycling of drilling mud into and out of the hole to insure that all cuttings are removed therefrom.

When the system of the present invention is used, ground water will ordinarily fill any space which remains in the reamed pilot hole circumscribing the casing. Such ground water will provide natural flotation and lubrication of the casing. In addition, if desired, a lubricating fluid can be injected into this space to further facilitate the advancing of the casing into the hole.

In the preferred embodiment of the present invention, the pilot drill string used in drilling the pilot hole remains in the hole. A washover pipe is advanced into and along the path of the pilot hole from one side of the obstacle circumscribing the pilot string. The pilot string remains in place and need not be dismantled as the washover pipe is being advanced. The reaming apparatus is located at the leading end of the washover pipe, and the washover pipe is rotated as it is advanced into the hole to ream the hole to a larger diameter. The drilling mud is injected into the hole through the annular space between the pilot string and the washover pipe and exits at the reaming apparatus. The auger is attached to the outer circumference of the washover pipe and impells the drilling mud containing the cuttings from the reaming apparatus toward the trailing end of the production casing.

It is contemplated that relatively strong transverse forces will be exerted by the auger on the leading end of the casing. The path of the pilot hole is arcuate and transverse forces will be exerted on the leading end of the auger and transmitted to the casing as it attempts to follow this arcuate path. Accordingly, it is preferred that a section of larger diameter, thick walled pipe be interposed in the washover pipe at the leading end of the auger. Additionally, a relatively thick auger section should be used at its leading end so that the edges of the auger provide a bearing surface which acts against the inside walls of the leading end of the production casing. In this manner, the system of the present invention will be capable of withstanding the large transverse forces exerted on the leading end of the auger and transmitted to the production casing.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

1. General Description

Figure 1:
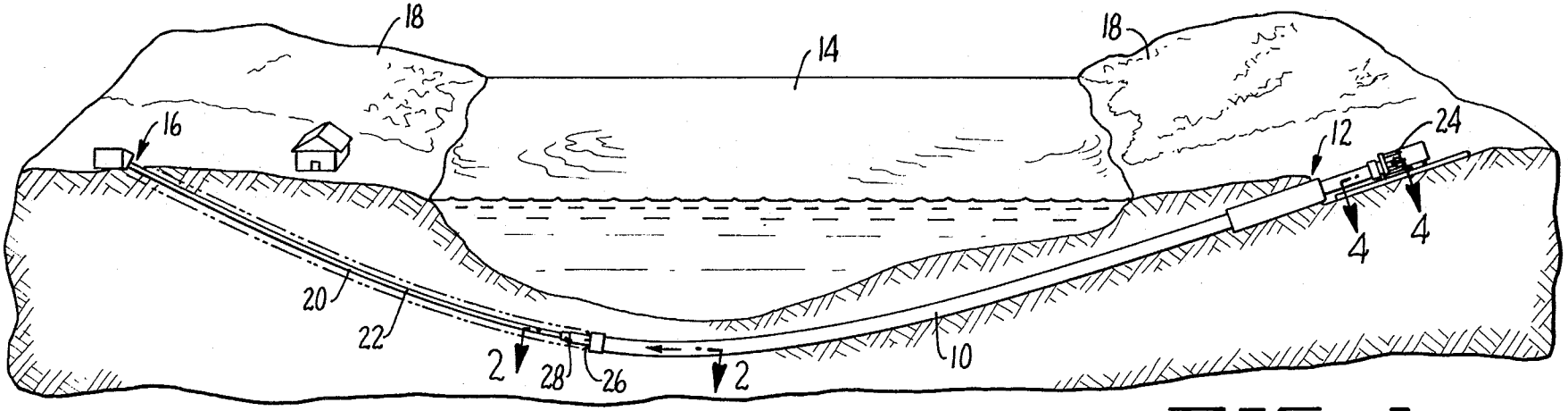
FIG. 1 is a perspective view of the installation of a production casing according to the teachings of the present invention.

The present invention provides a method for implacing a production casing 10 along an inverted underground arcuate path, as illustrated in FIG. 1. The path extends from a first position 12 on one side of a surface obstacle such a river 14 to a second position 16 on the other side of the obstacle. Positions 12 and 16 are at or near the surface of the ground 18 surrounding river 14, and thus it is necessary that the path have an inverted arcuate shape as illustrated.

The present invention applies to drilling techniques wherein a pilot hole 20 is initially drilled along the chosen inverted underground arcuate path from the first position 12 on one side of river 14 to a second position 16 at the other side. Such techniques are demonstrated in my U.S. Pat. No. 3,878,903 issued Apr. 22, 1975 for APPARATUS AND PROCESS FOR DRILLING UNDERGROUND ARCUATE PATHS. The pilot hole is drilled using a drill bit having a trailing drill string 22 which occupies the pilot hole from one end to the other after the pilot hole has been completed.

In the system and method of the present invention, production casing 10 is advanced into and along the path of pilot hole 20 by a rig 24 located at the first position 12 on one side of river 14. As described in more detail hereinbelow, production casing 10 is advanced in following relationship to a reamer 26. Reamer 26 is mounted to the outer circumference of a washover pipe 28 which is advanced along the path of pilot hole 20 circumscribing pilot drill string 22. The cuttings from reamer 28 are entrained in drilling mud which is forced through the interior of casing 12 and out of the hole.

2. Detail Description

Figure 2:
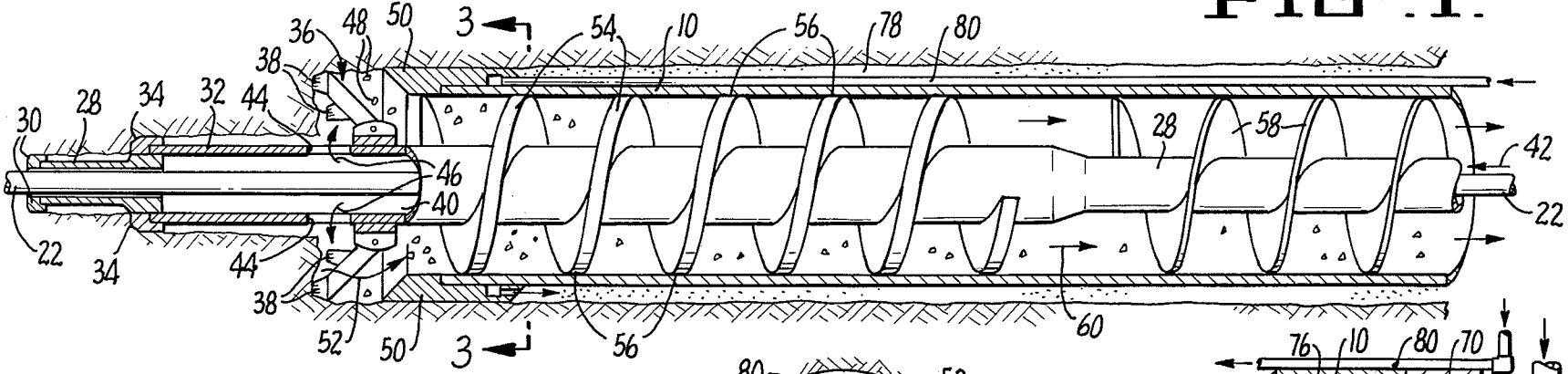
FIG. 2 is a sectional view taken along lines 2—2 of FIG. 1.

The system of the present invention is illustrated in more detail by way of reference to FIG. 2. Washover pipe 28 is provided with a plurality of teeth 30 at its leading end to open a path for the washover pipe as it is advanced along the path of the pilot hole around pilot drill string 22. A larger diameter, thick walled section 32 is interposed in washover pipe 28. A plurality of cutting teeth 34 are located at the leading end of large diameter section 32 to expand the hole to accommodate the width of the larger diameter section. Large diameter section 32 is followed by the remainder of the relatively smaller diameter washover pipe 28.

A reaming apparatus 36 having a plurality of flipout teeth 38 is mounted to washover pipe 28 along the outer circumference of larger diameter section 32. As washover pipe 28 is being advanced into and along pilot string 22, it is rotated by rig 24 (See FIG. 1) so that reamer teeth 38 ream the pilot hole to a larger diameter to accommodate production casing 10.

Figure 4:
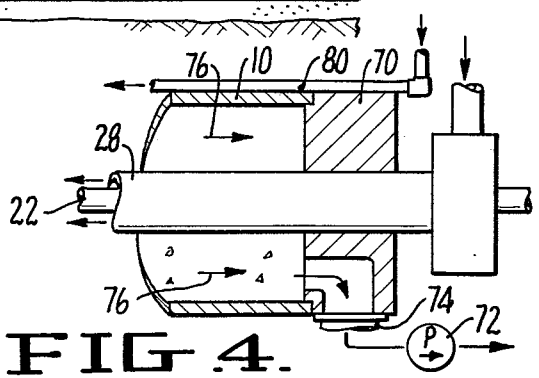
FIG. 4 is a sectional view taken along lines 4—4 of FIG. 1.

As washover pipe 28 is being advanced and rotated to operate reaming apparatus 36, drilling mud is injected through the annular space 40 between inner surface of the reamed pilot string 22 and washover pipe 28, as illustrated by arrow 42. The drilling mud is pumped into annular space 40 through a conduit 43 at the trailing end of washover pipe 28, as illustrated in FIG. 4. One or more apertures 44 are provided in washover pipe 28 adjacent reaming apparatus 36. The drilling mud injected through the annular space between washover pipe 28 and drill string 22 exits through apertures 44 proximate reamer 36, as illustrated by arrows 46. The cuttings 48 from reaming apparatus 36 are entrained in the drilling mud.

Production casing 10 is advanced into and along the inverted arcuate path of pilot hole 20 by rig 24, as illustrated in FIG. 1. It is preferred that production casing 10 be advanced nonrotatably into the ground, particularly when large diameter casings are used, to minimize stress caused by rotating the casing when it has an arcuate configuration. Casings with built in curvature may be used which cannot be rotated. However, it may be desirable in some circumstances to advance the production casing rotatably into the ground. In any such situation, production casing 10 is advanced so that the leading end thereof follows immediately behind reaming apparatus 36.

Figure 3:
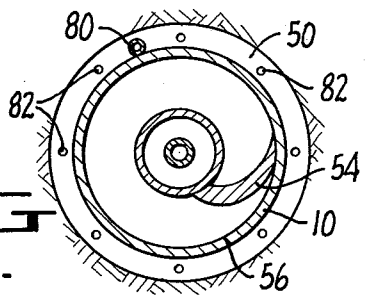
FIG. 3 is a sectional view taken along lines 3—3 of FIG. 2.

A pack-off blade 50 is mounted to the leading end of production casing 10 (See FIG. 2). Pack-off blade 50 circumscribes the leading end of the production casing and provides a sealing contact between the outer surfaces of the reamed pilot hole and production casing 10, as also illustrated in FIG. 3. Because of this sealing contact, the drilling mud containing the entrained cuttings from reamer 36 will pass into the leading end of the production casing as illustrated by arrow 52. Passage of the drilling mud containing the entrained cuttings into any annular space between the outer surface of production casing 10 and the inner surface of the reamed pilot hole is substantially prevented.

A relatively heavy auger flight 54 is mounted to the outer circumference of the large diameter segment 32 of washover pipe 28 immediately behind reaming apparatus 36. The blade portion of auger 54 has a relatively thick transverse dimension and provides a flat bearing surface 56 at its outer edges. Since pilot drill string 22 follows an arcuate path, relatively large transverse loads will be imposed by leading auger flight 54 against the interior walls of production casing 10. Accordingly, auger flight 54 with its wide bearing surfaces 56 is provided to withstand such transverse loads. In addition, auger flight 54 is mounted to the relatively larger diameter segment 32 of washover pipe 28 so that such transverse loads do not cause failure of the washover pipe.

Leading auger flight 54 impells the drilling mud containing the entrained cuttings 48 from reaming apparatus 36 from the leading end of production casing 10 toward the trailing end. Additional auger flights such as 58 may be mounted to washover casing 28 following auger flight 54 to further impell the drilling mud and the entrained tailings rearwardly, as illustrated by arrow 60. If desired, such auger flights may extend all the way to the trailing end of production casing 10.

In order to further insure that the drilling mud containing the entrained tailings is completely evacuated from the reamed pilot hole, suction may be provided at the trailing end of the production casing as illustrated in FIG. 4. A pack-box 70 is attached to the trailing end of production casing 10 to provide a seal between the production casing and washover pipe 28. A pump 72 communicates with the interior of production casing 10 through conduit 74. Pump 72 sucks the drilling mud containing the entrained tailings along the interior of casing 10, as illustrated by arrows 76, and out of the production casing.

Referring back to FIG. 2, it is apparent that the outer diameter of pack-off blade 50 is greater than the outer diameter of production casing 10. Accordingly, an annular void 78 will be left circumscribing the production casing. Void 78 will typically be filled with ground water to lubricate passage of production casing 10 along the path of the reamed pilot hole.

It may be desirable to inject a high lubricity fluid into void 78 to further facilitate the advancing of production casing 10 into the reamed pilot hole. Accordingly, a supply pipe 80 is mounted to the exterior of production casing 10, and extends from the trailing end illustrated in FIG. 4 to pack-off blade 50. A high lubricity fluid is injected into conduit 80 at the trailing end of production casing 10 to pack-off blade 50, in which it is distributed to and dispersed by a plurality of orifices 82, as illustrated in FIG. 3. The high lubricity fluid exiting orifices 82 serves to further lubricate the passage of production casing 10 into the pilot hole.

3. Operation

In operation, a pilot hole is initially drilled along an inverted underground arcuate path beneath the obstacle such as river 14 to be traversed. The pilot drill string 22 is left in the pilot hole. A washover casing 28 is then advanced and simultaneously rotated into and along the path of the pilot hole circumscribing pilot string 22. The reaming apparatus 36 attached to washover pipe 28 reams the pilot hole to a preselected diameter to accommodate the production casing.

Production casing 10 is advanced into and along the reamed pilot hole in following relationship to reaming apparatus 36. Pack-off blade 50 provides a seal between casing 10 and the sidewalls of the reamed pilot hole so that the drilling mud containing the cuttings from the reamer flows into the interior of the advancing casing. Auger 54 on rotating washover pipe 28 impells the drilling mud containing the entrained cuttings from the leading end of the production casing toward the trailing end thereof. Movement of the drilling mud containing the entrained tailings along production casing 10 is facilitated by the suction provided by pump 72 at the trailing end of the casing. In this manner, the drilling mud and the entrained tailings are substantially completely evacuated from the hole.

Complete evacuation of the drilling mud containing the entrained cuttings is desired so that the cuttings do not interfere with the progress of the production casing into the hole. In the present invention such cuttings will not enter the annular space surrounding the production casing and interfere with the advancing of the casing into the hole. Advancement of the production casing can be further enhanced by injecting a high lubricity fluid into the space circumscribing the production casing.

While a preferred embodiment of the system and method of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims:

What is claimed is:

1. A method of emplacing a cylindrical casing beneath an obstacle along an underground inverted arcuate path between first and second ground level locations along the corresponding path of a pilot hole, said method comprising the steps of: placing a pilot string along an invert arcuate path under said obstacle; reaming an annulus about the pilot string with a reaming apparatus to a pre-selected diameter greater than the diameter of said casing, thereby to establish a reamed pilot hole including an annular void in the ground; introducing a casing behind said reamed pilot hole; providing a substantially sealing contact between the outside surface of said casing and the inside surface of said circumscribing ground of said reamed pilot hole at a location between the reaming site and the annular void; introducing a transport fluid at the reaming site; entraining the cuttings from said reaming step in the transport fluid; advancing said casing into and along said reamed pilot hole in following relation to said reaming apparatus along the inverted arcuate path; and impelling transport fluid and entrained cuttings into the leading portion of said casing and through said casing toward the trailing portion thereof to remove said transport fluid and entrained cuttings, whereby cuttings are prevented from settling in the case-circumscribing annular void between the outside surface of said casing and the inside surface of said circumscribing ground of said reamed pilot hole.

2. A method as recited in claim 1, further comprising the step of introducing a lubricating fluid into the sealed-off, case-circumscribing annular void for promoting advancement of said casing along said reamed pilot hole.

3. A method as recited in claim 1, wherein said impelling step includes providing a rotating auger behind said reaming apparatus, and rotating said auger to impell the transport fluid and entrained cuttings from the reaming site.

4. A method as recited in claim 1, wherein said impelling step includes pumping the transport fluid and entrained fluids from the reaming site.

5. A method as recited in claim 4, further impelling steps of sealing the interior of the casing against the atmosphere and withdrawing the transport fluid and entrained cuttings from the interior of the casing by suction.

6. A method as recited in claim 1, wherein said introducing the casing comprises introducing a casing having curvature and non-rotatably advancing said curved casing into and along the reamed pilot hole.

7. Apparatus for emplacing a cylindrical casing under an obstacle along an underground inverted arcuate path between first and second ground level locations along the corresponding path of a previously placed pilot string occupying at least a part of said invert arcuate path, said apparatus comprising: means for reaming the pilot hole to a pre-selected diameter greater than the diameter of the casing to form a reamed hole including a circumscribing annular void in the ground around said pilot string; means for crowding said casing into the ground in immediate following relation to said reaming apparatus along said invert arcuate path; means for providing a seal between the outer surface of the casing and the inner surface of circumscribing ground at a location between the reaming site and at least part of the annular void circumscribing the casing; means for introducing a transport fluid at the site of said reaming to entraining the cuttings from reaming in said transport fluid; and means for impelling transport fluid and entrained cuttings into the portion of said casing adjacent said reaming means and through said casing away from said reaming means to remove said transport fluid and entrained cuttings, whereby cuttings are prevented from settling in the sealed-off portion of said casing circumscribing annular void.

8. Apparatus as recited in claim 7, wherein said transport fluid introducing means is a washover pipe and wherein impelling means comprises an auger fixed to the outer circumference of the washover pipe.

9. Apparatus as recited in claim 7, wherein the transverse dimension of the blade of said auger is relatively large and the outer surface of said auger blade is substantially flat to provide a bearing surface adapted to bear against the interior surface of the production casing to counteract transverse loads imposed on said auger.

10. Apparatus of claim 7, wherein said impelling means comprises an auger located within the casing.

11. Apparatus of claim 7, wherein said sealing means comprises a pack-off blade circumscribing the casing at the leading end thereof.

12. Apparatus of claim 7 and additionally comprising a washover pipe having an inner diameter greater than the outer diameter of the pilot string and an outer diameter less than the inner diameter of the casing, means for advancing and simultaneously rotating the washover pipe into and along the path of the pilot hole in circumscribing relationship with the pilot string so that said washover pipe is advanced into the pilot hole simultaneous with the casing, the reaming means and the impelling means being attached to the washover pipe and said washover pipe including at least one aperture proximate said reaming means, wherein said entraining means comprises means for injecting transport fluid from the trailing end of the washover pipe through the annular space between the interior of the washover pipe and the pilot string to and out through said aperture to entrain the cuttings from the drilling means in said transport fluid, and wherein said means for rotating and advancing said auger comprises said washover pipe advancing and simultaneously rotating means.

13. Apparatus according to claim 12, further including means located proximate the leading end of the casing for impelling the transport fluid and entrained cuttings into the reaming apparatus adjacent portion of the casing and through the interior of the casing for discharging said fluid at the trailing end of said casing.

14. A method for emplacing a casing beneath an obstacle between first and second ground level locations comprising the steps of: placing a pilot string between said ground level locations along an invert arcuate path under said obstacle; reaming an annulus in circumscribing ground about said pilot string to a pre-selected diameter producing cuttings, introducing a cylindrical casing behind said reamed pilot hole, said casing being of smaller diameter than said annulus; sealing the annulus forms by the outer circumference of said casing and case-circumscribing ground from the interior of said casing; introducing a transport fluid interior of said casing and entraining said cuttings; introducing a lubricating fluid into the sealed-off case-circumscribing annulus; advancing said casing behind said reamed pilot hole; and withdrawing the transport fluid and entrained cuttings in isolation from said case-circumscribing annulus.

* * * * *